US006899521B2

(12) United States Patent
Horng et al.

(10) Patent No.: US 6,899,521 B2
(45) Date of Patent: May 31, 2005

(54) AIRFLOW GUIDING STRUCTURE FOR A HEAT-DISSIPATING FAN

(75) Inventors: Alex Horng, Kaohsiung (TW); Yin-Rong Hong, Kaohsiung (TW); Ching-Sheng Hong, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 10/652,471

(22) Filed: Sep. 2, 2003

(65) Prior Publication Data

US 2005/0025620 A1 Feb. 3, 2005

(51) Int. Cl.[7] ..... F04D 29/54
(52) U.S. Cl. ..... 415/208.2; 415/119; 415/211.2; 415/220
(58) Field of Search ..... 415/119, 208.2, 415/211.2, 220, 223, 192, 121.2, 175–178; 416/247 R; 361/695–697; 165/80.3, 121

(56) References Cited

U.S. PATENT DOCUMENTS 2,021,086 A * 11/1935 Oskamp ..... 415/208.2
6,398,492 B1 * 6/2002 Cho et al. ..... 415/211.2
6,561,762 B1 * 5/2003 Horng et al. ..... 415/211.2
6,695,045 B2 * 2/2004 Chang ..... 165/80.3

FOREIGN PATENT DOCUMENTS

AU 232110 A * 1/1961
JP 62-243993 A * 10/1987

* cited by examiner

*Primary Examiner*—Christopher Verdier
(74) *Attorney, Agent, or Firm*—Bacon & Thomas, PLLC

(57) ABSTRACT

A heat-dissipating fan includes a casing having an air outlet, a base mounted in the air outlet, and a plurality of ribs each mounted between the base and the casing. An impeller is mounted on the base and includes a plurality of blades. Each rib includes in sequence at least a first radial guiding portion, a first circumferential guiding portion, and a second radial guiding portion. Each of the first radial guiding portion and the second radial guiding portion extends in a direction having an inclining angle with an axial direction of the air outlet. The first radial guiding portion, the first circumferential guiding portion, and the second radial guiding portion guide airflow passing through the air outlet and increase wind pressure of the airflow when the impeller is turning.

20 Claims, 10 Drawing Sheets

AIRFLOW GUIDING STRUCTURE FOR A HEAT-DISSIPATING FAN

BACKGROUND OF THE INVENTION

1. Field of the Invention

The present invention relates to an airflow guiding structure for a heat-dissipating fan.

2. Description of Related Art

FIG. 1 of the drawings illustrates a typical heat-dissipating fan including a casing 10, an air inlet 11 defined in a side of the casing 10, an air outlet 12 defined in the other side of the casing 10, a base 13, and a plurality of ribs 14. The base 13 is secured by the ribs 14 in the air outlet 12. A stator (not shown) and an impeller (not shown) are mounted to the base 13. When the impeller turns, air is sucked into the casing 10 via the air inlet 11 and exits the casing 10 via the air outlet 12 to dissipate heat from an object such as a fin or a central processing unit.

Although the above-mentioned heat-dissipating fan provides a certain heat-dissipating effect, the heat-dissipating operation can only be performed on an object directly below the air outlet 12, as the airflow can only flow along an axial direction of the air outlet 12. In a case that the object is not located directly below the air outlet 12, the airflow cannot flow through the object in a uniform manner, resulting in non-uniform heat dissipation and poor heat-dissipating effect. On the other hand, since the object is generally mounted in a limited space such as in a notebook type computer (or a laptop computer) in a position not directly below the base 13 or outside the area of air outlet, the heat-dissipating effect is adversely affected. The heat-dissipating effect is also adversely affected if the object is too large to be completely within an area directly below the heat-dissipating fan. Further, turbulence tends to occur when the airflow is passing through the ribs 14. Noise is thus generated while having a lower heat-dissipating effect.

OBJECTS OF THE INVENTION

An object of the present invention is to provide a heat-dissipating fan with an airflow guiding structure including a casing, a base in an air outlet of the casing, and a plurality of ribs between the casing and the base. Each rib includes a plurality of radial guiding portions and at least one circumferential guiding portion. Each radial guiding portion and the circumferential guiding portion of the respective rib extend in a direction having an inclining angle with respect to an axial direction of the air outlet for guiding airflow, increasing wind pressure, reducing wind noise, and improving the overall heat-dissipating efficiency.

Another object of the present invention is to provide a heat-dissipating fan with an airflow guiding structure including a casing, a base in an air outlet of the casing, and a plurality of ribs between the casing and the base. Each rib includes a plurality of radial guiding portions and at least one circumferential guiding portion. The airflow can be guided to any desired position for dissipating heat by means of altering the inclining directions of the radial guiding direction and the circumferential guiding portion of the respective rib, thereby concentrating the airflow or increasing the heat-dissipating area. The overall heat-dissipating efficiency is improved, and the assembly and design of the heat-dissipating fan are more flexible.

A further object of the present invention is to provide a heat-dissipating fan with an airflow guiding structure including a casing, a base in an air outlet of the casing, and a plurality of ribs between the casing and the base. Each rib includes a plurality of radial guiding portions and at least one circumferential guiding portion. The ribs are zigzag and thus provide an aesthetically pleasing appearance and added value for the heat-dissipating fan.

SUMMARY OF THE INVENTION

In accordance with an aspect of the invention, a heat-dissipating fan includes a casing having an air outlet, a base mounted in the air outlet, and a plurality of ribs each mounted between the base and the casing. An impeller is mounted on the base and includes a plurality of blades. Each rib includes in sequence at least a first radial guiding portion, a first circumferential guiding portion, and a second radial guiding portion. Each of the first radial guiding portion and the second radial guiding portion extends in a direction having an inclining angle with an axial direction of the air outlet. The first radial guiding portion, the first circumferential guiding portion, and the second radial guiding portion guide airflow passing through the air outlet and increase wind pressure of the airflow when the impeller is turning.

The inclining angles of the first radial guiding portion and the second radial guiding portion of the respective rib may be identical to or different from each other. The first circumferential guiding portions of the ribs are located on a circumference of a common circle. The first circumferential guiding portion may extend radially outward or inward with respect to the axial direction of the air outlet.

In an embodiment of the invention, each rib further includes a second circumferential guiding portion and a third radial guiding portion, with the second circumferential guiding portion being connected between the second radial guiding portion and the third radial guiding portion. The inclining angles of the first radial guiding portion, the second radial guiding portion, and the third radial guiding portion of the respective rib with respect to the axial direction of the air outlet may be identical to or different from one another. The second circumferential guiding portions of the ribs are located on a circumference of another common circle that is preferably concentric with the common circle of the first circumferential guiding portions of the ribs. The second circumferential guiding portion of the respective rib may extend radially outward or inward with respect to the axial direction of the air outlet.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
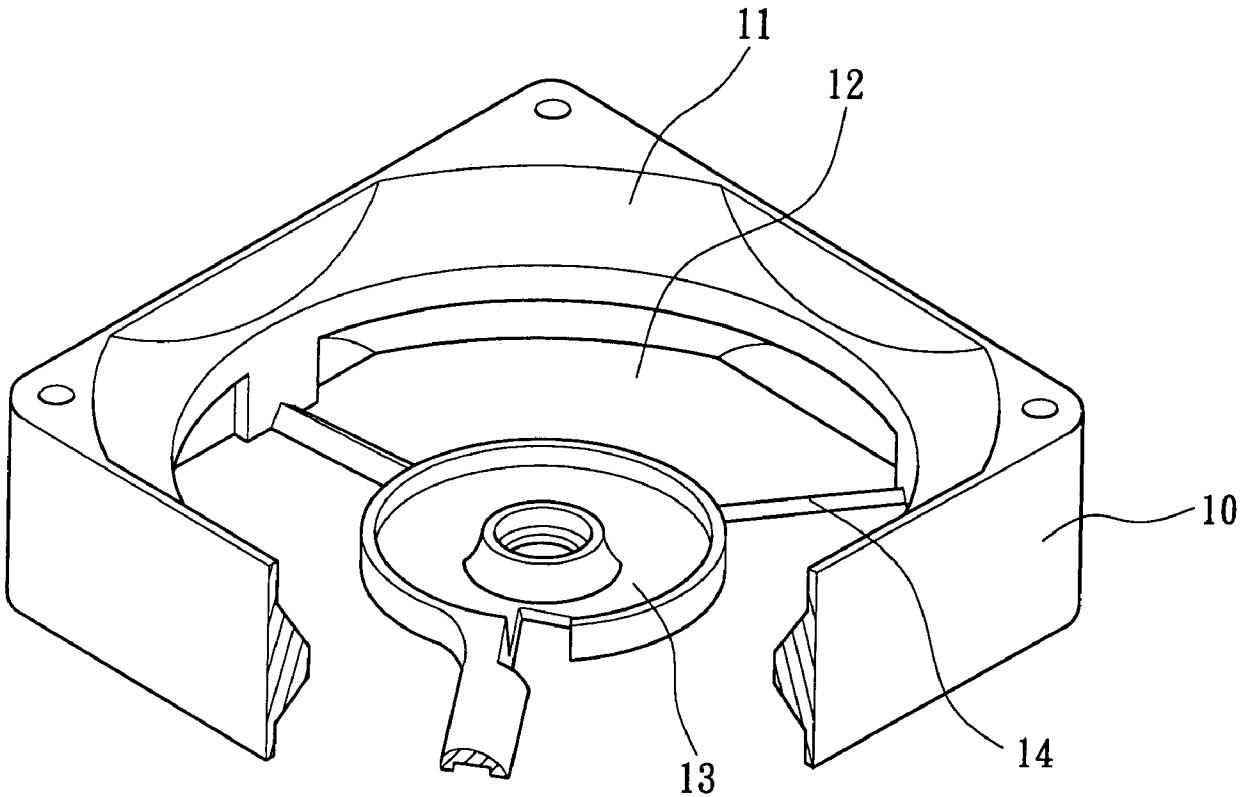
FIG. 1 PRIOR ART
FIG. 1 is a perspective view, partly cutaway, of a conventional heat-dissipating fan.

Preferred embodiments of the present invention are now to be described hereinafter in detail, in which the same reference numerals are used in the preferred embodiments for the same parts as those in the prior art to avoid redundant description.

Figure 2:
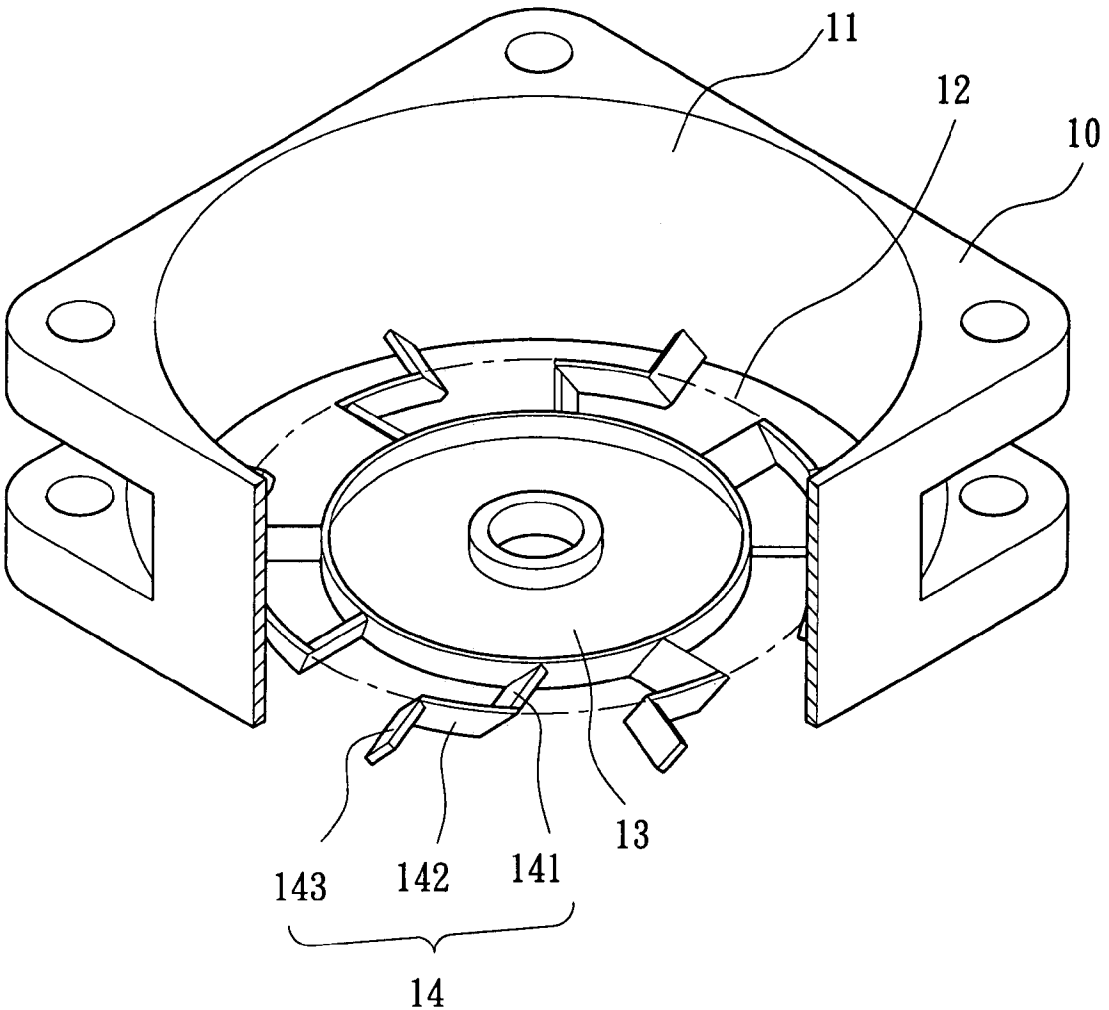
FIG. 2 is a perspective view, partly cutaway, of a heat-dissipating fan with a first embodiment of an air guiding structure in accordance with the present invention.
Figure 3:
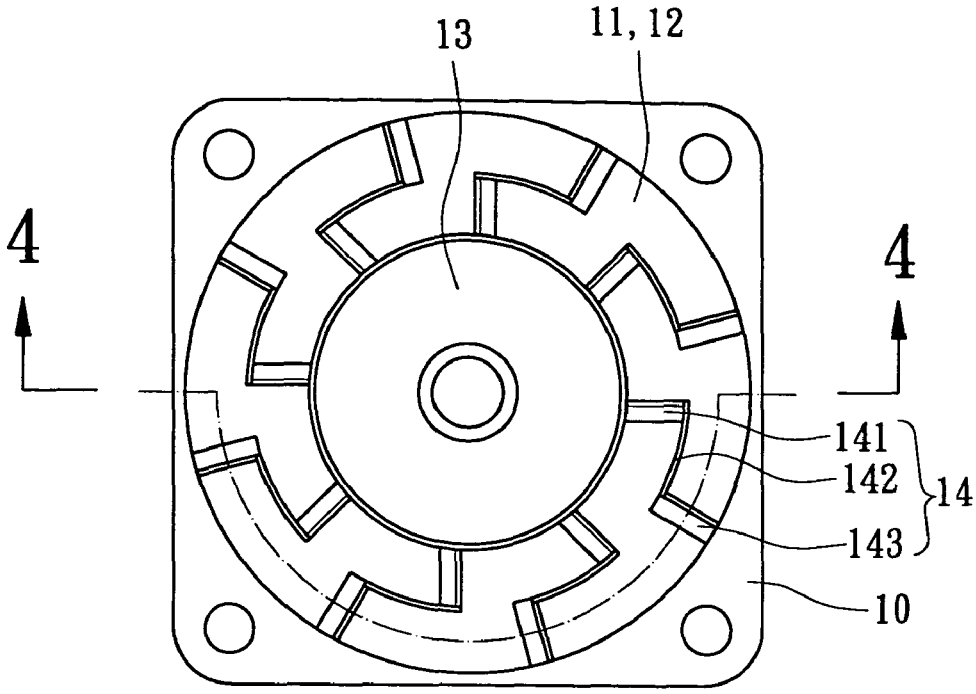
FIG. 3 is a top view of the heat-dissipating fan in FIG. 2.
Figure 4:
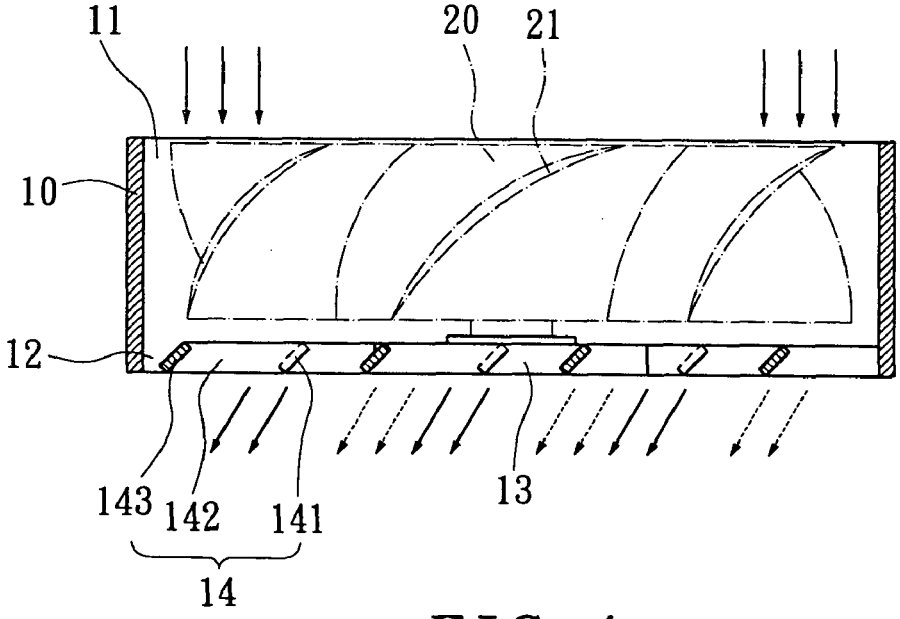
FIG. 4 is a sectional view taken along line 4—4 in FIG. 3.

Referring to FIGS. 2 through 4, a heat-dissipating fan with a first embodiment of an air guiding structure in accordance with the present invention includes a casing 10, an air inlet 11, an air outlet 12, a base 13, and a plurality of ribs 14. The casing 10 may be made of plastics or metal, with the air inlet 11 and the air outlet 12 being respectively defined in two opposite sides of the casing 10. The base 13 is located on the air outlet side, and an impeller 20 (FIG. 4) is mounted on the base 13. The ribs 14 extend between the base 13 and the casing 10 and are spaced away from one another in an angular direction.

Figure 4A:
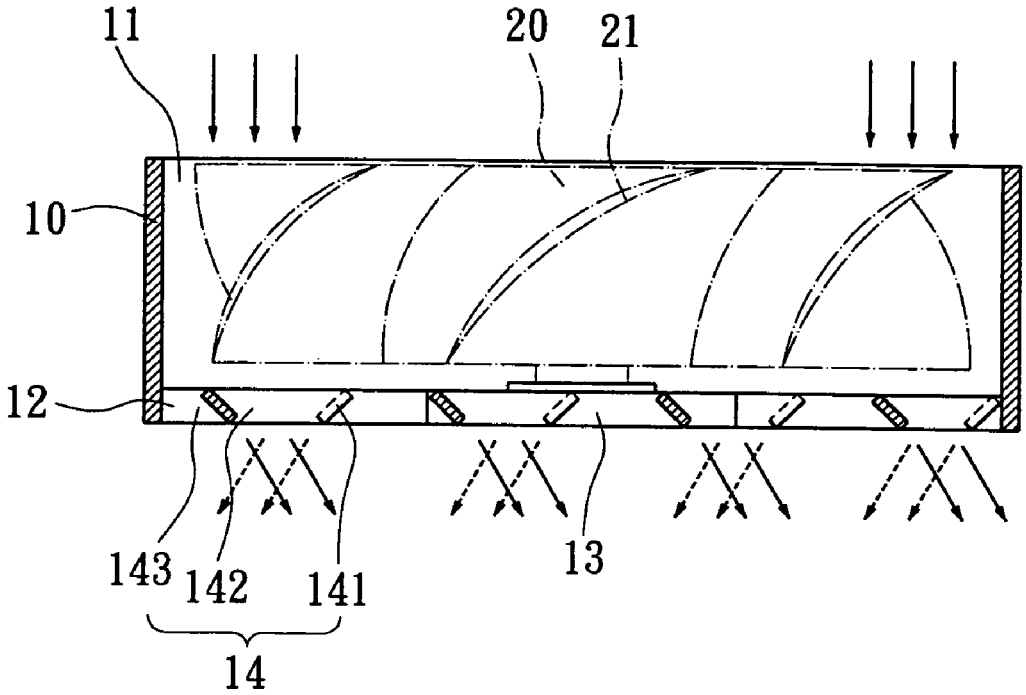
FIG. 4A is a sectional view, similar to FIG. 4, of another air guiding structure in accordance with the present invention.

Each rib 14 is preferably zigzag and includes in sequence a first radial guiding portion 141, a circumferential guiding portion 142, and a second radial guiding portion 143. As illustrated in FIG. 4, each of the first radial guiding portion 141 and the second radial guiding portion 143 extend in a direction having an inclining angle with an axial direction of the air outlet 12. Further, the inclining angle of the first radial guiding portion 141 and the inclining angle of the second radial guiding portion 143 are proportional to an inclining angle of blades 21 of the impeller 20. The inclining angle of the first radial guiding portion 141 maybe the same as or different from that of the second radial guiding portion 142, as best shown in FIG. 4A. The circumferential guiding portions 142 of the ribs 14 are preferably on a circumference of a common circle. Further, the casing 10, the base 13, and the ribs 14 may be separate elements that can be assembled with one another to form a heat-dissipating fan.

Still referring to FIG. 4, when the impeller 20 turns, the blades 21 of the impeller 20 introduce airflow into the casing 10 via the air inlet 11 and expel the airflow via the air outlet 12, thereby dissipating heat from an object such as a fin or central processing unit (not shown). When the airflow passes through the ribs 14, since the inclining angles of the first radial guiding portion 141 and the second radial guiding portion 143 of the respective rib 14 are proportional with the inclining angle of the blades 21 of the impeller 20, the airflow is smoothly guided by the first radial guiding portion 141 and the second radial guiding portion 143 of the respective rib 14 to a position below the air outlet 12, thereby reducing turbulence while the airflow is passing through the ribs 14. Noise generated by tangential wind is reduced, and the wind pressure is increased. Further, the circumferential guiding portions 142 of the ribs 14 separate the radial guiding portions 141 and 143 so that the radial guiding portions are mis-aligned in the radial direction and thereby divide the airflow into an inner portion adjacent to a center of the air outlet 12 and an outer portion adjacent to a circumference of the air outlet 12. In a case that the inclining angle of the first radial guiding portion 141 of the respective rib 14, the circumferential guiding portion 142 remarkably reduces the possibility of mutual interference between the inner portion and the outer portion of the airflow. Further, the zigzag ribs 14 comprised of the first radial guiding portion 141, the circumferential guiding portion 142, and the second radial guiding portion 142 provides an aesthetically pleasing appearance and added value for the heat-dissipating fan.

Figure 5:
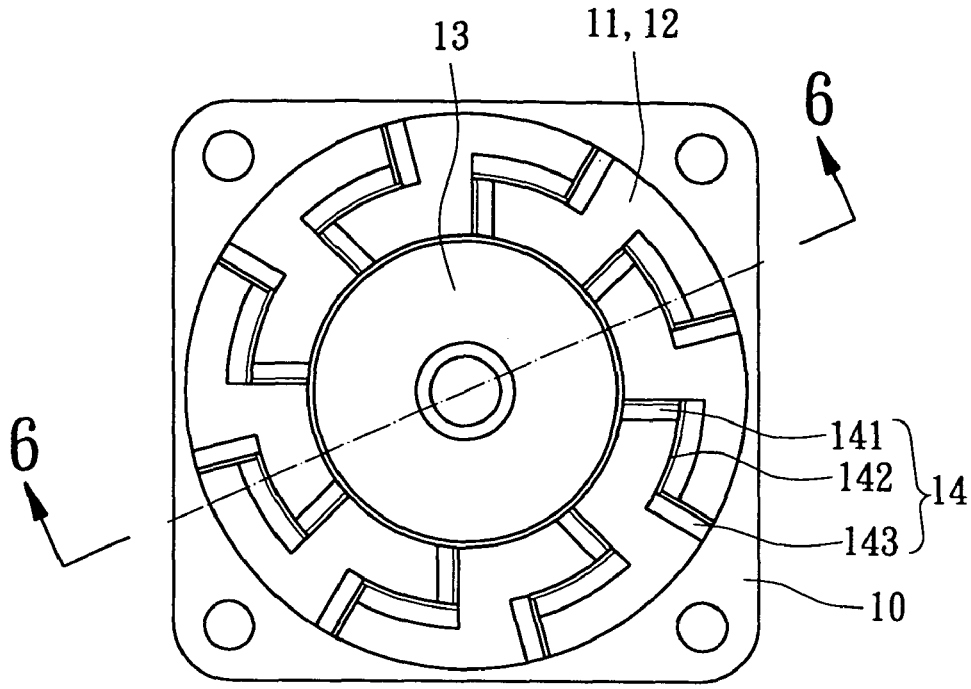
FIG. 5 is a top view of a heat-dissipating fan with a second embodiment of the air guiding structure in accordance with the present invention.
Figure 6:
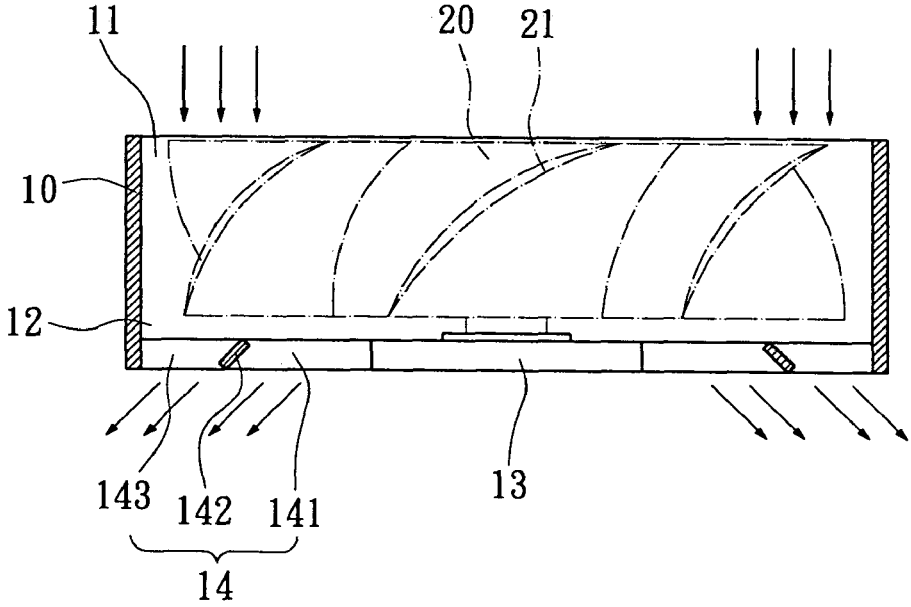
FIG. 6 is a sectional view taken along line 6—6 in FIG. 5.

FIGS. 5 and 6 illustrate a heat-dissipating fan with a second embodiment of the air guiding structure in accordance with the present invention. In this embodiment, the circumferential guiding portion 142 of the respective rib 14 extends downward and radially outward with respect to the axial direction of the air outlet 12. Thus, besides the smooth airflow guiding function provided by the first and second radial guiding portions 141 and 143 of the respective rib 14, the circumferential guiding portion 142 of the respective rib 14 guides the airflow to a position outside the air outlet 12. As a result, the heat-dissipating area is increased. Further, the heat-dissipating fan is suitable for use in a limited space (e.g., in a notebook type computer or laptop computer), as the airflow can be guided to an object in a position not directly below the air outlet 12 or to an object having a relatively large size for more uniform heat dissipation. Thus, the ribs 14 provide an air-guiding effect.

Further, as illustrated in FIG. 6, following the inclining direction of the circumferential guiding portion 142 of the respective rib 14, the wind pressure is increased by the circumferential guiding portion 142 of the respective rib 14. Further, since the wind pressure of the outer portion of the airflow exiting the air outlet 12 is increased due to downward and radially outward inclination of the circumferential guiding portion 142 of the respective rib 14, the inner portion of the airflow tends to flow radially outward. The air flowing efficiency is thus improved.

Figure 7:
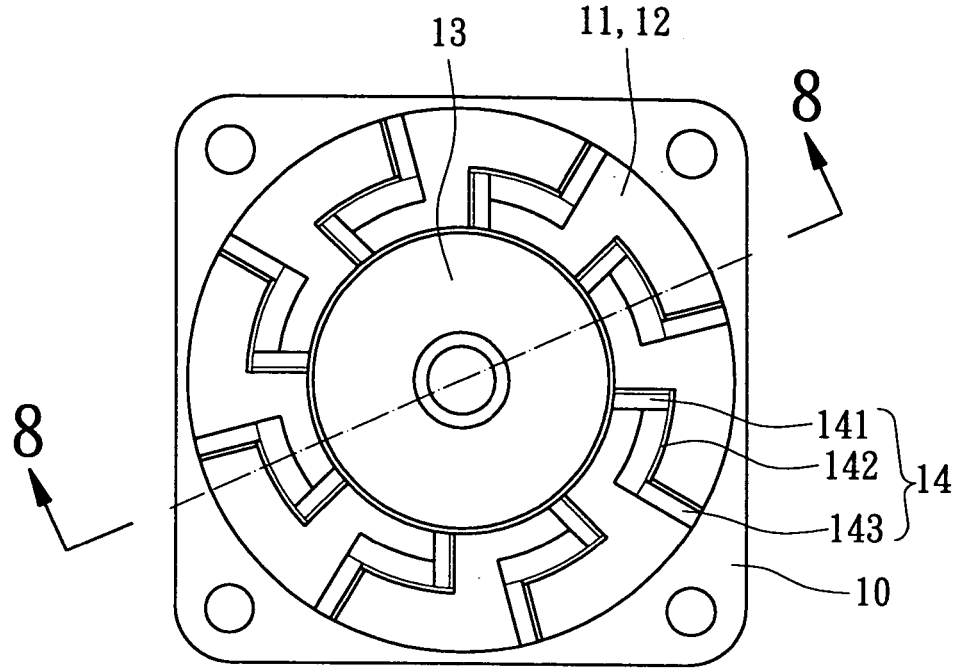
FIG. 7 is a top view illustrating a heat-dissipating fan with a third embodiment of the air guiding structure in accordance with the present invention.
Figure 8:
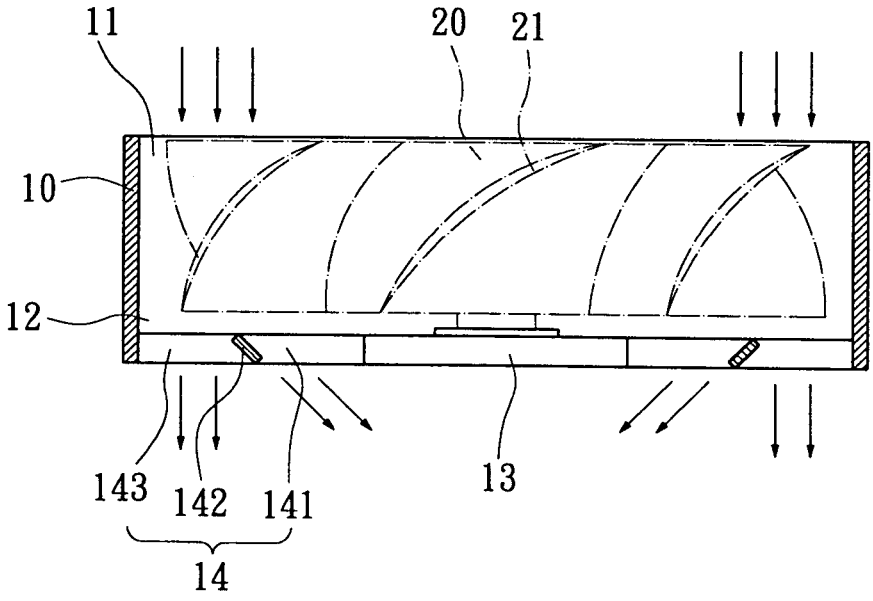
FIG. 8 is a sectional view taken along line 8—8 in FIG. 7.

FIGS. 7 and 8 illustrate a heat-dissipating fan with a third embodiment of the air guiding structure in accordance with the present invention. In this embodiment, the circumferential guiding portion 142 of the respective rib 14 extends downward and radially inward with respect to the axial direction of the air outlet. Thus, besides the smooth airflow guiding function provided by the first and second radial guiding portions 141 and 143 of the respective rib 14, the circumferential guiding portion 142 of the respective rib 14 guides the airflow to a position below the base 13, thereby improving the heat-dissipating efficiency for an object located directly below the base 13. Further, as illustrated in FIG. 8, following the inclining direction of the circumferential guiding portion 142 of the respective rib 14, the wind pressure is increased by the circumferential guiding portion 142 of the respective rib 14. Further, since the wind pressure of the inner portion of the airflow exiting the air outlet 12 is increased due to downward and radially inward inclination of the circumferential guiding portion 142 of the respective rib 14, the outer portion of the airflow tends to flow radially inward. The air flowing efficiency is thus improved.

Figure 9:
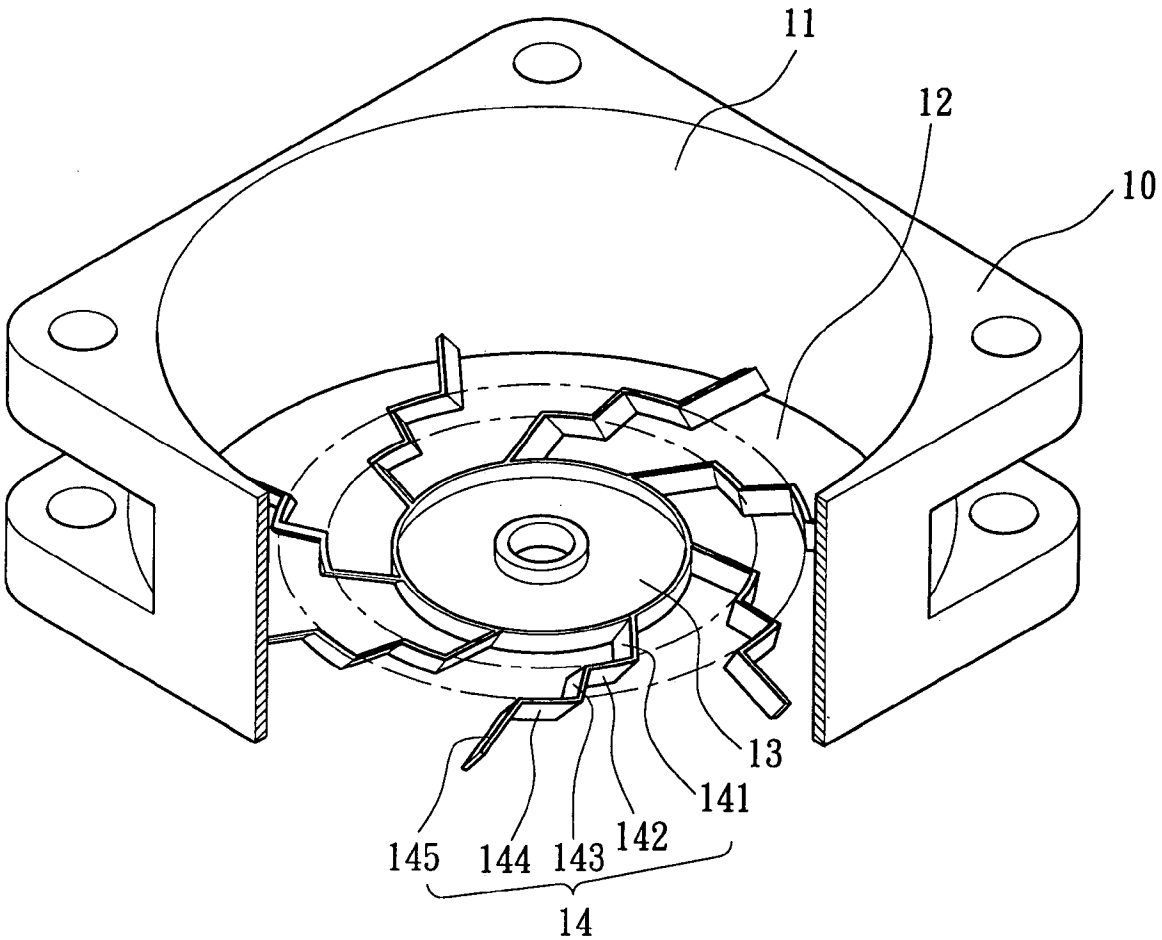
FIG. 9 is a perspective view, partly cutaway, of a heat-dissipating fan with a fourth embodiment of the air guiding structure in accordance with the present invention.
Figure 10:
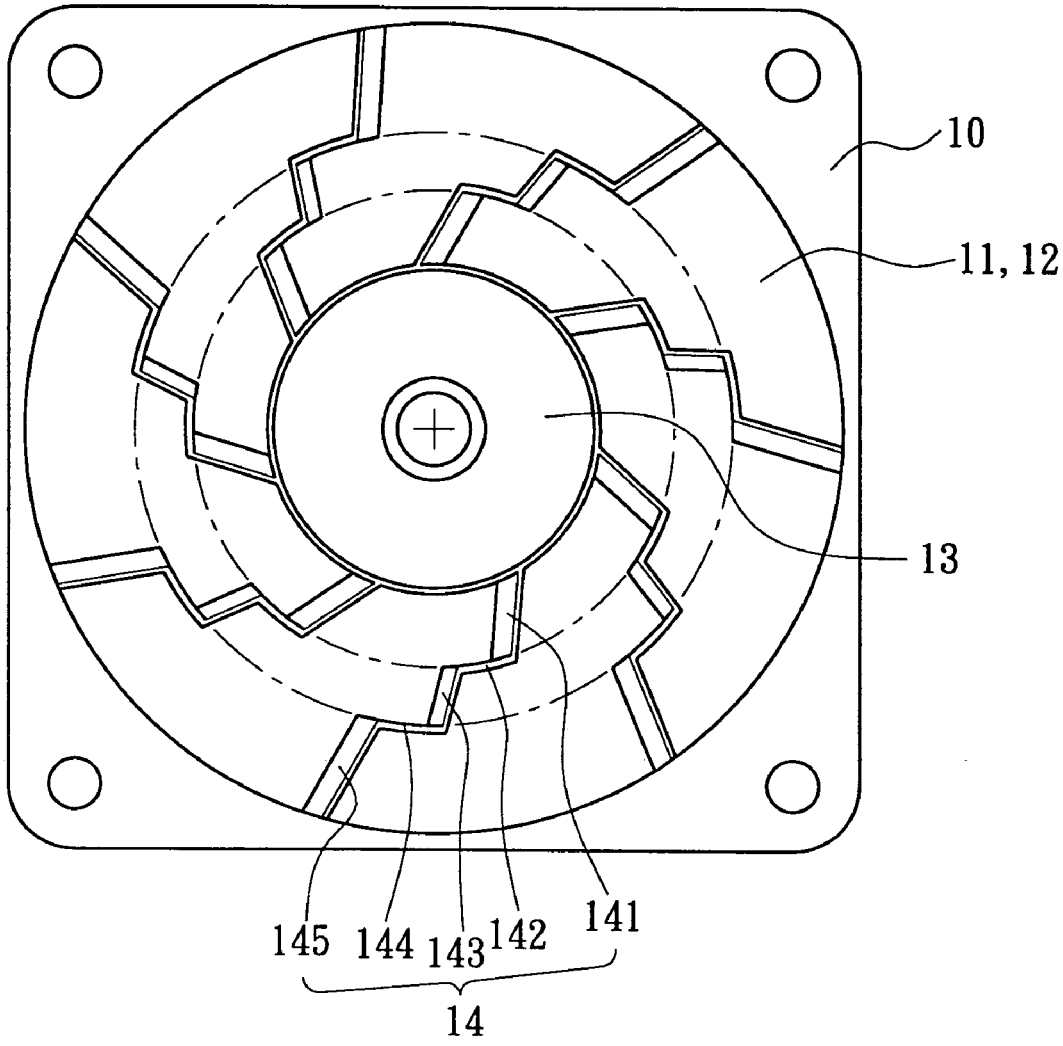
FIG. 10 is a top view of the heat-dissipating fan in FIG. 9.
Figure 10A:
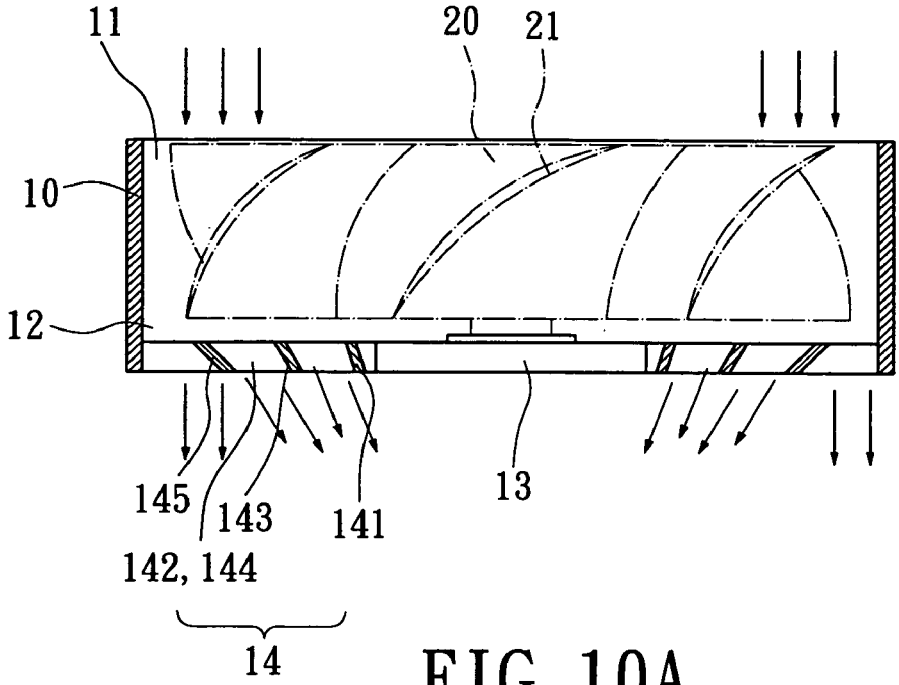
FIGS. 10A–10C are sectional views of another air guiding structure in accordance with the present invention.

FIGS. 9 and 10 illustrated a heat-dissipating fan with a fourth embodiment of the air guiding structure in accordance with the present invention. In this embodiment, each rib 14 is preferably zigzag and includes in sequence a first radial guiding portion 141, a first circumferential guiding portion 142, and a second radial guiding portion 143, a second circumferential guiding portion 144, and a third radial guiding portion 145. As illustrated in FIG. 10, each of the first radial guiding portion 141, the second radial guiding portion 143, and the third radial guiding portion 145 extend in a direction having an inclining angle with an axial direction of the air outlet 12, with the inclining angles of the first, second, and third radial guiding portions 141, 143, and 145 being in proportion to an inclining angle of the blades 21 of the impeller 20. The inclining angles of the first, second, and third radial guiding portion 141, 143, and 145 may be identical to or different from one another as shown in FIGS. 10 and 10A.

Figure 10B:
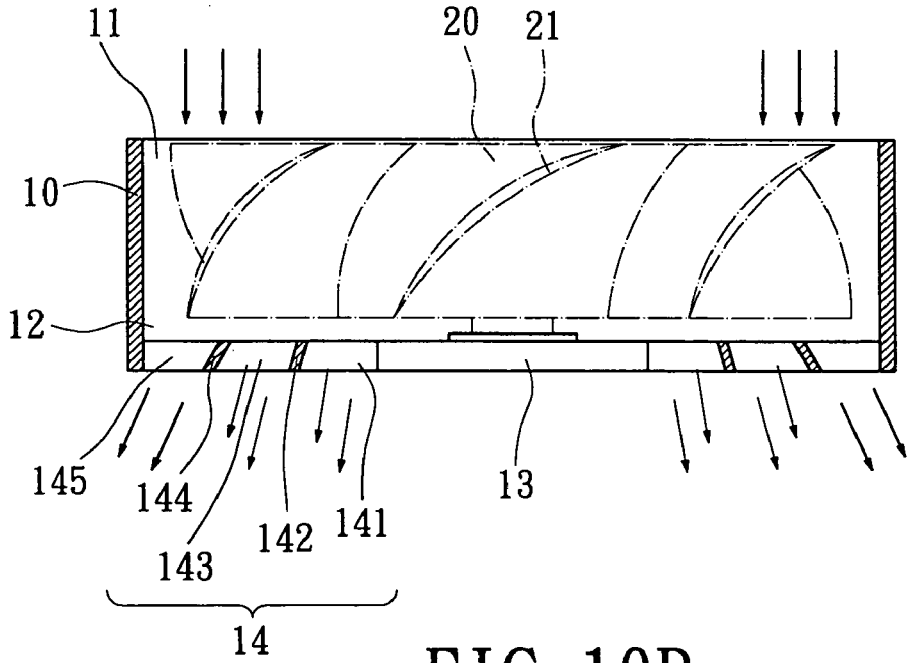
Figure 10C:
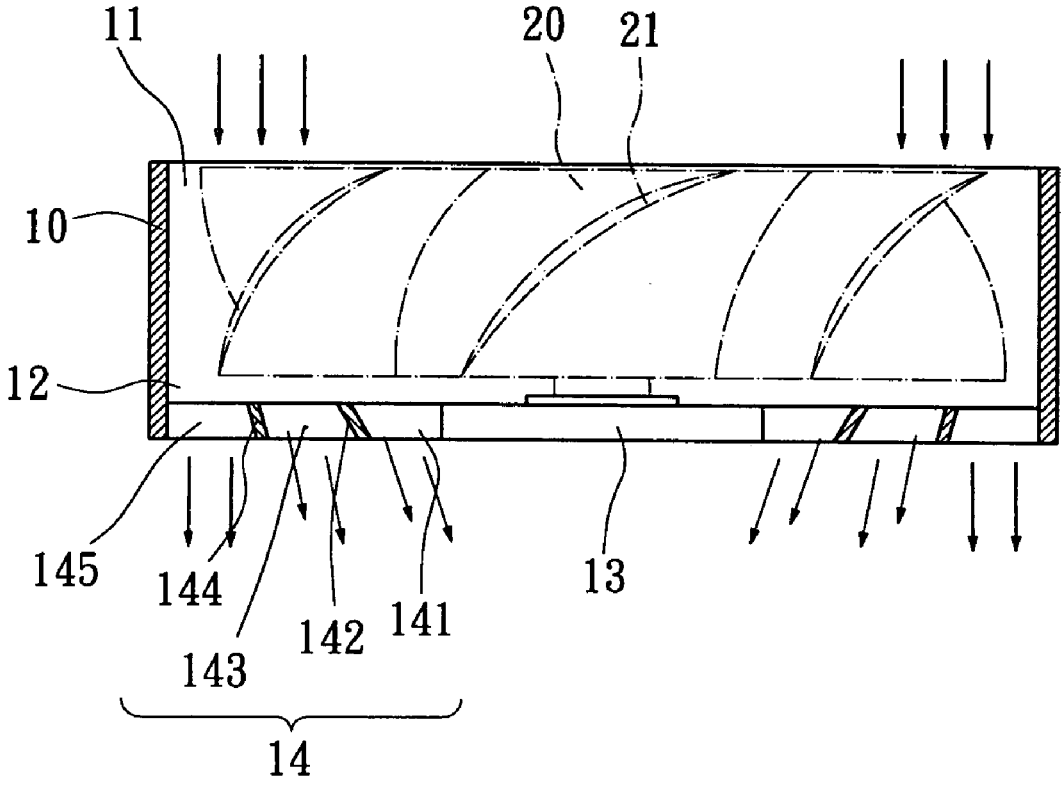

The first circumferential guiding portions 142 of the ribs 14 are preferably on a circumference of a first common circle. The second circumferential guiding portions 144 of the ribs 14 are preferably on a circumference of a second common circle that is concentric with the first common circle. Each of the first circumferential guiding portions 142 and second circumferential guiding portions 144 may extend in a direction parallel to the axial direction of the air outlet 12. Alternatively, each of the first circumferential guiding portions 142 and second circumferential guiding portions 144 may extend downward and radially outward or inward, as best shown in FIGS. 10B and 10C. By this arrangement, the first and second circumferential guiding portions 142 and 144 may selectively guide the airflow to a position outside the air outlet 12 or directly below the base 13 for concentrating the airflow for dissipating heat. The heat-dissipating efficiency with respect to the object on the air outlet side of the casing 10 is improved. Further, following the inclining directions of the first and second circumferential guiding portions 142 and 144, the wind pressure is increased by the first and second circumferential guiding portions 142 and 144.

As illustrated in FIGS. 2 through 10C, by means of providing a plurality of radial guiding portions 141, 143, and 145 and a plurality of circumferential guiding portions 142 and 144, the airflow direction can be guided. Further, the number, inclining directions, and the inclining angles of the radial guiding portions 141, 143 and 145 and the circumferential guiding portions 142 can be altered in response to the size, location, and shape of the blades 21 of the impeller 20 and of the object to be cooled as well as the amount of heat to be dissipated. The assembly and design of the heat-dissipating fan are thus more flexible.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A heat-dissipating fan comprising:

a casing having an air outlet, an impeller being adapted to be mounted on a base and having a plurality of blades;

a plurality of non-interconnected ribs each mounted between the base and the casing, each said rib including in sequence at least a first radial guiding portion, a first circumferential guiding portion, and a second radial guiding portion, each of the fist radial guiding portion and the second radial guiding portion extending in a direction having an inclining angle with an axial direction of the air outlet, the first radial guiding portion, the first circumferential guiding portion, and the second radial guiding portion guiding airflow passing through the air outlet and increasing wind pressure of the airflow when the impeller is turning, wherein said first circumferential portion separates said first and second radial guiding portions to cause said first radial guiding portion to be mis-aligned with the second radial guiding portion along a radial direction.

2. The beat-dissipating fan as claimed in claim 1, wherein the inclining angles of the first radial guiding portion and the second radial guiding portion of the respective rib are identical to each other.

3. The heat-dissipating fan as claimed in claim 1, wherein the inclining angles of the first radial guiding portion and the second radial guiding portion of the respective rib are different from each other.

4. The heat-dissipating fan as claimed in claim 1, wherein the first circumferential guiding portions of the ribs are located on a circumference of a common circle.

5. The heat-dissipating fan as claimed in claim 1, wherein the first circumferential guiding portion extends radially outward with respect to the axial direction of the air outlet.

6. The heat-dissipating fan as claimed in claim 1, wherein the first circumferential guiding portion extends radially inward with respect to the axial direction of the air outlet.

7. The heat-dissipating fan as claimed in claim 1, wherein each said rib further includes a second circumferential guiding portion and a third radial guiding portion, with the second circumferential guiding portion being connected between the second radial guiding portion and the third radial guiding portion.

8. The heat-dissipating fan as claimed in claim 7, wherein the inclining angles of the first radial guiding portion, the second radial guiding portion, and the third radial guiding portion of the respective rib with respect to the axial direction of the air outlet are identical to one another.

9. The heat-dissipating fan as claimed in claim 7, wherein the inclining angles of the first radial guiding portion, the second radial guiding portion, and the third radial guiding portion of the respective rib with respect to the axial direction of the air outlet ate different from one another.

10. The heat-dissipating fan as claimed in claim 7, wherein the second circumferential guiding portions of the ribs are located on a circumference of a common circle.

11. The heat-dissipating fan as claimed in claim 7, wherein the second circumferential guiding portion of the respective rib extends radially outward with respect to the axial direction of the air outlet.

12. The heat-dissipating fan as claimed in claim 7, wherein the second circumferential guiding portion for the respective rib extends radially inward with respect to the axial direction of the air outlet.

13. The heat-dissipating fan as claimed in claim 10, wherein the first circumferential guiding portions of the ribs are located on a circumference of another common circle that is concentric with the common circle of the second circumferential guiding portion of the ribs.

14. The heat-dissipating fan as claimed in claim 13, wherein the first circumferential guiding portion and the second circumferential guiding portion of the respective rib extends radially outward with respect to the axial direction of the air outlet.

15. The heat-dissipating fan as claimed in claim 13, wherein the first circumferential guiding portion and the second circumferential guiding portion of the respective rib extends radially inward with respect to the axial direction of the air outlet.

16. A heat-dissipating fan comprising:

a casing having an air outlet;

a base mounted in the air outlet, an impeller being adapted to be mounted on the base and having a plurality of blades;

a plurality of zigzag ribs each mounted between the base and the casing, each said rib including a plurality of radial guiding portions and a plurality of circumferential guiding portions, with each said circumferential guiding portion being connected between two of said radial guiding portions that are adjacent to each other, each said radial guiding portion extending in a direction having an inclining angle with an axial direction of the air outlet, the radial guiding portions and the circumferential guiding portions guiding airflow passing through the air outlet and increasing wind pressure of the airflow when the impeller is turning.

17. The heat-dissipating fan as claimed in claim 16, wherein the inclining angles of the radial guiding portions of the respective rib with respect to the axial direction of the air outlet are identical to one another.

18. The heat-dissipating fan as claimed in claim 16, wherein the including angles of the radial guiding portions of the respective rib with respect to the axial direction of the air outlet are different from one another.

19. The beat-dissipating fan as claimed in claim 16, wherein each said circumferential guiding portion for the respective rib extends radially outward with respect to the axial direction of the air outlet.

20. The heat-dissipating fan as claimed in claim 16, wherein each said circumferential guiding portion for the respective rib extends radially inward with respect to the axial direction of the air outlet.

* * * * *